United States Patent [19]

Bergstedt

[11] 4,157,302

[45] Jun. 5, 1979

[54] METHOD AND APPARATUS FOR TREATING LIQUID-CONTAINING SUBSTANCE MIXTURES, PARTICULARLY FIBRE SUSPENSIONS

[75] Inventor: Karl E. Bergstedt, Timrå, Sweden

[73] Assignee: Sunds Aktiebolag, Sundsvall, Sweden

[21] Appl. No.: 853,038

[22] Filed: Nov. 21, 1977

[30] Foreign Application Priority Data

Dec. 6, 1976 [SE] Sweden ..... 7613659

[51] Int. Cl.[2] ..... B01D 29/20; B01D 29/38

[52] U.S. Cl. ..... 210/81; 210/106; 210/138; 210/409

[58] Field of Search ..... 210/76, 79, 80, 81, 210/194, 195 S, 138, 409, 411, 412, 106

[56] References Cited

U.S. PATENT DOCUMENTS

| | | | |
|---|---|---|---|
| 1,270,042 | 6/1918 | Moisant | 210/409 X |
| 2,066,479 | 1/1937 | MacIssac | 210/411 X |
| 2,724,508 | 11/1955 | Luther | 210/194 X |
| 3,907,681 | 9/1975 | Corrigan et al. | 210/409 X |
| 4,045,342 | 8/1977 | Küster et al. | 210/96 R X |

FOREIGN PATENT DOCUMENTS

| | | | |
|---|---|---|---|
| 1205292 | 9/1970 | United Kingdom | 210/409 |
| 1287605 | 9/1972 | United Kingdom | 210/409 |
| 1463775 | 2/1977 | United Kingdom | 210/409 |

*Primary Examiner*—William A. Cuchlinski, Jr.
*Attorney, Agent, or Firm*—Lerner, David, Littenberg & Samuel

[57] ABSTRACT

Methods and apparatus for concentrating liquid-containing substances are disclosed. The disclosed method includes contacting liquid-containing substances such as fiber suspensions with separating means as the substance flows in a first direction so that a portion of the liquid is separated from the liquid-containing substance, withdrawing the liquid through the separating means in a second direction, intermittently interrupting the flow of the liquid downstream from that point of withdrawal to terminate the flow of the liquid through the separating means and preventing return flow of the separated liquid through the separating means. The apparatus disclosed includes means for directing the flow of the liquid-containing substance in a first direction, separating means for separating a portion of the liquid therefrom in a second direction, means for interrupting the flow of the separated liquid downstream from the separating means in a second direction, and means for preventing the return flow of the liquid through the separating means. In a preferred embodiment the apparatus includes a membrane which acts as a non-return valve for the separated liquid during interrupted flow of the separated liquid.

57 Claims, 14 Drawing Figures

METHOD AND APPARATUS FOR TREATING LIQUID-CONTAINING SUBSTANCE MIXTURES, PARTICULARLY FIBRE SUSPENSIONS

FIELD OF THE INVENTION

The present invention relates to a method and an apparatus for separating liquid from mixtures of substances, preferably fiber suspensions such as cellulose pulp. More particularly, the present invention relates to such a separation of liquid carried out for concentrating the suspension or in connection with washing or treatment of the suspension with various chemicals.

BACKGROUND OF THE INVENTION

In concentrating pulps from concentrations of from 1–5% up to 8–15% or higher, the necessary amount of liquid to be removed can be separated by a screening device without the need to supply any replacing liquid. When washing or treating with chemicals, such as in bleaching, the treatment liquid is supplied through a special device, which is arranged with respect to the screening device so that the liquid so supplied is passed through the suspension transversely to the direction of flow of the suspension. Such a transverse flow has the effect that the liquid in which the fiber material is suspended is entirely or partially exchanged against the liquid so supplied.

While the fibrous suspension is being passed through a passageway, the liquid can be screened off through a screening device, thus resulting in a pulp body with an increased fiber concentration. This, however, can give rise to plug formation in the passageway and thereby render continued screening impossible. This problem has been eliminated by the method and apparatus of the present invention.

SUMMARY OF THE INVENTION

In accordance with the present invention, the applicant has discovered that these problems can be overcome by contacting the liquid-containing substance with separating means as that substance flows in a first direction so that at least a portion of the liquid can be separated from the liquid-containing substance through the separating means, withdrawing the liquid from the liquid-containing substance through the separating means in a second direction, intermittently interrupting the flow of the liquid downstream from the point of removal from the separating means so as to terminate the flow of the liquid through the separating means, and preventing the return flow of at least a portion of the separated liquid through the separating means.

In a preferred embodiment of the present invention, the liquid is withdrawn into a collecting chamber and the flow of liquid is interrupted at the liquid outlet from the collecting chamber. Preferably, additional liquid, under pressure, is supplied to assist in moving the liquid-containing substance in the first direction, and most preferably, that liquid is supplied through the collecting chamber.

In another embodiment of the present invention, the pressure of the liquid-containing substance is detected prior to contacting with the separating means and the supply of additional liquid is controlled in response to a predetermined pressure change in the liquid-containing substance.

In another embodiment of the present invention, the flow rate of the liquid through the separating means is monitored and the flow of liquid is interrupted in response to predetermined changes in that flow rate. Also in accordance with this embodiment, it is preferred that the supply of additional liquid also be controlled in response to those predetermined changes in the flow rate.

In another embodiment of the present invention, the flow of the liquid through the separating means as well as the supply of additional liquid to assist in moving the liquid-containing substance in the first direction are both controlled by a timer.

In another embodiment of the present invention, treatment liquid is supplied to the liquid-containing substance to at least partially exchange the treatment liquid for the liquid being separated through the separating means. Preferably this treatment liquid is supplied transversely to the flow of the liquid-containing substance in the first direction.

In accordance with another aspect of the present invention, an apparatus is provided for including means for directing the flow of a liquid-containing substance in the first direction, separating means for separating at least a portion of the liquid from the liquid-containing substance in a second direction, means for interrupting the flow of a separated liquid at a point downstream of the separating means in said second direction, and means for preventing the return flow of the separated liquid through the separating means.

In a preferred embodiment, membrane means are provided for preventing return flow of the liquid through the separating means, and the separating means comprises a screen member substantially parallel to the flow of the liquid-containing substance in the first direction. Most preferably the membrane means is located on the downstream side of the screen member.

In another embodiment, a collecting chamber is provided for the separated liquid and is located downstream of the separating means. Valve means are provided in connection with the outlet of the collecting chamber for interrupting the flow of the liquid separated from the liquid-containing substance.

In another embodiment of the apparatus of the present invention, one end of the membrane is sealed to the means for directing the flow of the liquid-containing substance at a point adjacent to the outlet from that means and downstream of the separating means. Preferably in this embodiment the opposite end of the membrane terminates at a point downstream of the outlet of the means for directing the flow of the liquid-containing substance so that the membrane does not prevent the return flow of a portion of the liquid through a portion of the separating means upstream of that end of the membrane.

In another embodiment of the present invention, additional liquid is supplied to the liquid-containing substance through the collecting chamber, and a valve means is associated with the inlet to the collecting chamber for controlling the flow of the additional liquid thereto, preferably as controlled by a timing means.

In a preferred embodiment of the present invention, a plurality of membranes are employed, and the collecting chamber includes a plurality of collecting chamber compartments, each of which includes one of the membranes. Preferably the collecting chamber compartments extend axially along the means for directing the flow of the liquid-containing substance, and each of the membranes is sealed to the separating means along the axially extending edge thereof.

In another embodiment of the apparatus of the present invention, projecting members are located along the exterior wall of the separating means in order to prevent a portion of the membrane from contacting the surface of the separating means when the flow of separated liquid is intermittently interrupted. Preferably where the means for directing the flow of the liquid-containing substance is cylindrical in shape, the projecting members are annular rings encircling this cylindrical means.

In another embodiment of the apparatus of the present invention, the liquid-collecting chambers are defined by axially extending wall means on the external surface of the separating means.

In another embodiment of the apparatus of the present invention, the separating means is located within the means for directing the flow of the liquid-containing substance and the means for preventing return flow of the liquid through the separating means is located on the interior surface of the separating means.

BRIEF DESCRIPTION OF THE DRAWINGS

The present invention will be described with reference to the accompanying drawings in which.

DETAILED DESCRIPTION

Figure 1:
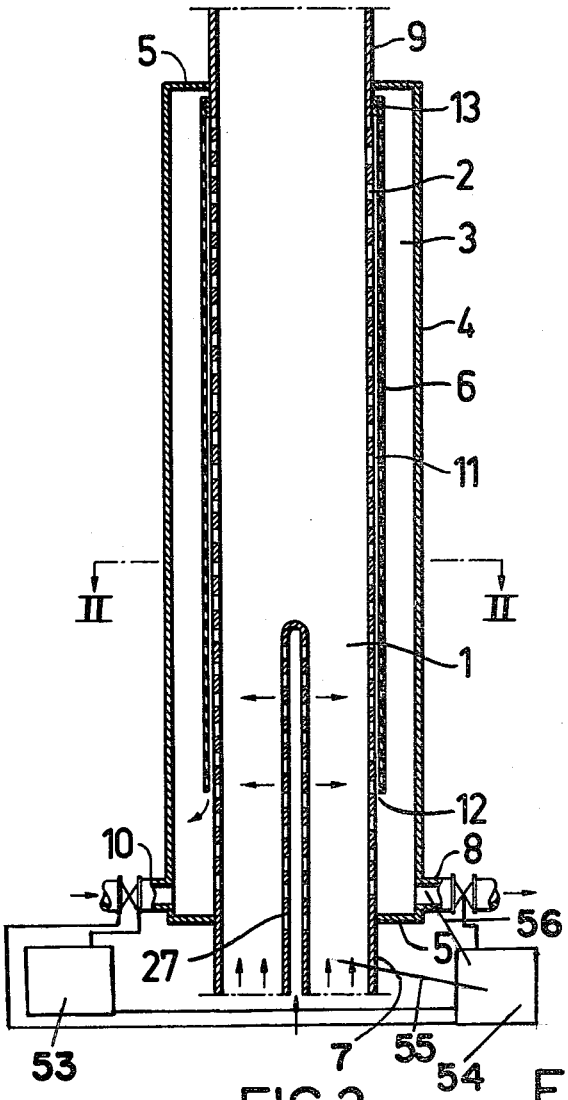
FIG. 1 shows a front axial sectional view of one embodiment of the apparatus of the present invention.
Figure 3:
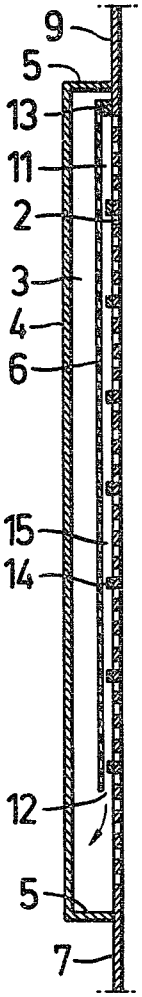
FIG. 3 is a partial axial sectional view of another apparatus in accordance with the present invention.
Figure 2:
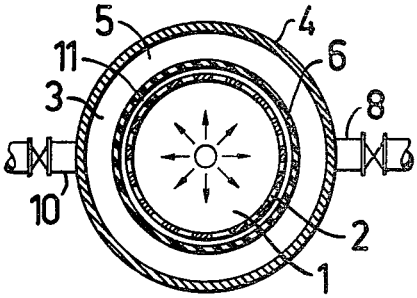
FIG. 2 is a partial radial sectional view taken along Section II—II of FIG. 1.
Figure 6:
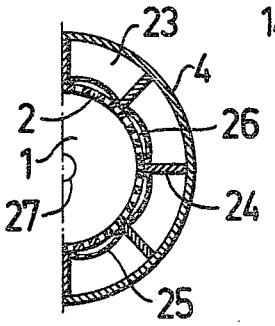
FIG. 6 is a partial radial section view of another apparatus in accordance with the present invention.
Figure 7:
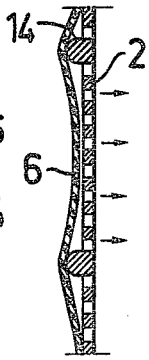
FIG. 7 is a partial section view of a portion of the apparatus of FIG. 3.

Referring to FIGS. 1 and 2, a preferred embodiment of the apparatus according to the invention is shown schematically. The apparatus as shown therein has a cylindrical shape, but may also have a cross-section of rectangular or other shape. The main components of this apparatus are a perforated central portion 1, comprising a passageway or container for axial flow of a suspension, preferably with a perforated or slotted screening casing 2, a filtrate chamber 3 defined by an outer casing 4 with end walls 5, a valve member in the form of a membrane 6, a pulp inlet 7, filtrate outlet 8, pulp outlet 9 and scavenging liquid inlet 10. The diameter of the membrane 6 enclosing the screening casing 2 is slightly greater than the screening casing 2 so that a space 11 is formed between and extending all about said membrane and said casing. In the axial direction the membrane encloses the entire or substantially entire screening casing adjacent the pulp outlet 9, but does not enclose the entire screening casing adjacent the pulp inlet 7. The space 11 between the membrane and the screening casing here communicates with the filtrate chamber 3 through a gap or an opening 12, which in the embodiment according to FIGS. 1 and 2 extends continuously about the entire screening casing, but does not necessarily do so. The membrane can also extend in an axial direction along the entire screening casing adjacent the pulp inlet 7, and the opening 12 can be located at an unperforated portion of the central portion 1. The essential prerequisite is that communication between the space 11 and the filtrate chamber 3 be ensured. At the other end of the membrane 6, however, communication between the space 11 and the filtrate chamber 3 is to be prevented. For this reason, the membrane is attached sealingly to a ring 13, which in turn is attached in the axial direction beyond the screening casing and in the embodiment shown immediately prior to the pulp outlet 9. The ring 13 thus constitutes a defining wall of the space 11. Referring to FIG. 3, an embodiment is shown which differs slightly from the embodiment described above. In this embodiment a plurality of rings 14 are arranged on the screening casing 2. The filtrate chamber 3 is provided with a filtrate outlet (not shown) and, if necessary, with a scavenging liquid inlet in the same way as in the embodiment shown in FIGS. 1 and 2. This applies also to the embodiments according to FIGS. 4, 5 and 6 discussed below. The rings 14 are arranged so as to divide the space 11 into a plurality of smaller spaces 15, which alternatingly communicate with each other in the axial direction along the screening casing, and thus with the filtrate chamber 3 (FIG. 3) and are separated from each other, and thus from the filtrate chamber 3 (FIG. 7).

Figure 4:
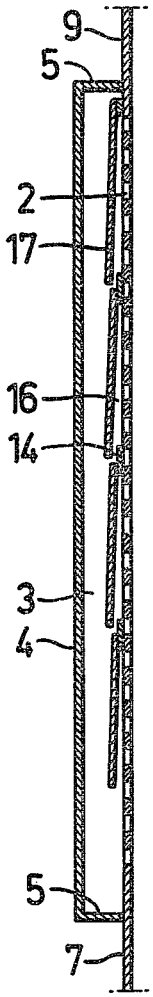
FIG. 4 is a partial sectional axial view of another apparatus in accordance with the present invention.

In another embodiment, as shown in FIG. 4, the screening casing 2 is provided with a plurality of rings 14, which constitute axial defining walls for spaces 16 extending about the circular screening casing 2. The casing thus constitutes the inner defining wall, as in the case of the embodiment shown in FIG. 3. The spaces 16 are defined radially outwardly by valve means 17 and alternatingly communicate with the filtrate chamber and are separated therefrom.

Figure 5:
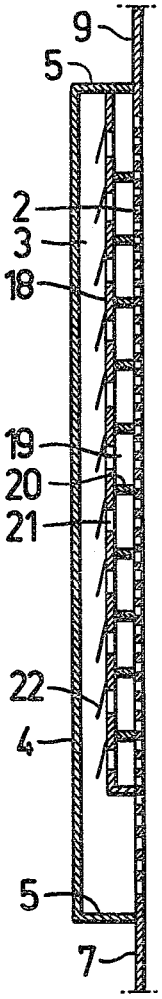
FIG. 5 is a partial axial sectional view of another apparatus in accordance with the present invention.

In a further embodiment shown in FIG. 5, a casing 18 is provided between the screening casing 2 and the outer casing 4. Said casing 18 constitutes an outer defining wall for circular compartments 19, which further are defined inwardly by the screening casing 2, and in the axial direction by partition walls 20. The casing 18 includes openings 21 connecting the copartments 19 to the filtrate chamber 3. For each compartment 19 at least one opening 21 is provided, and at least one valve means 22 is provided to close the opening so that the compartments 19 alternatingly can communicate with the filtrate chamber 3 and be separated therefrom. The valve means, for example, may be a membrane or a so-called non-return valve. The openings 21 may be designed as preferably interrupted slots extending all about or as one or several holes for each compartment 19. The valve means 22 shown by way of a section in the drawing is in a schematic manner a membrane extending all about, a membrane extending only over one opening 21, or a non-return valve.

The filtrate chamber 3 may also be divided into axially extending compartments. Such an embodiment is shown in FIG. 6, wherein the compartments are designated by 23 and the walls between the compartments by 24. In each filtrate chamber compartment 23 a membrane 25 is provided, which outwardly defines a space 26 communicating with the filtrate chamber compartment at that end of the screening casing 2 which is located closest to the pulp inlet, i.e., in principle in the same manner as at the embodiments described above.

The apparatuses shown advantageously can be used for liquid treatment, for example, washing of cellulose pulp, in which case liquid is supplied in order to entirely or partially replace the liquid in which the cellulose-containing material is suspended. In FIGS. 1 and 2 a tubular supply member 27 for supplying washing liquid is shown, which is intended to displace the suspension liquid substantially in the radial direction, as schematically indicated by dashed arrows therein. The design and extension of the supply member 27 can be varied in several different ways. This member does not have to be a centrally disposed pipe, but may consist of supply means located at another location in the central portion 1, or at the periphery thereof.

Figure 8:
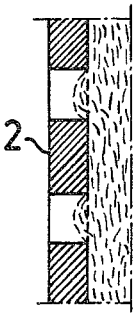
FIG. 8 is a partial sectional view of a portion of the screen wall member of FIGS. 1 through 5.

For such apparatus having a cylindrical screening casing a diameter/length ratio of 0.1–1.0, preferably 0.2–0.8 and most preferably 0.2–0.5 is proposed. In certain applications both smaller and greater ratios than those indicated above can be chosen. The apparatus described above operate as follows:

The liquid-containing substance mixture, such as a fiber suspension, is supplied to the apparatus in the direction of the arrows shown in the figures through pulp inlet 7, usually at a concentration of 1–5%, and the liquid is screened off through the screening casing 2. Therefore, in the central portion 1 a pulp body with increased fiber concentration is obtained, which due to the pressure difference over the screening casing 2 is retained in the central portion. As pulp suspension is continuously supplied through the inlet the inlet pressure increases and, consequently, the pulp body is compressed. In this manner the pressure difference over the screening casing increases, thereby giving rise to an increased retaining force. The size of that retaining or friction force depends not only on the size of the pressure difference but also on the surface formation of the perforated casing and on the properties of the pulp. Fibers pressed into the openings on the screening casing usually bring about a substantial retaining force (see FIG. 8). When the desired concentration of the pulp body to 8–15% or higher, such as from 15–30%, or under certain circumstances even 30–40% has been achieved, the filtrate outlet 8 is closed. Thus the pressure in the filtrate chamber 3 increases, and the pressure difference over the screening casing 2 consequently decreases. The retaining force on the pulp body thereby decreases, and the size of said force is not sufficient to retain the pulp body. In this manner the body, due to the compression previously effected and to the increased inlet pressure, is moved in the direction towards the pulp outlet 9. When the inlet pressure has decreased, preferably to the original pressure, the valve in the filtrate outlet is again opened, and the liquid is screened off through the screening casing. The aforedescribed process is repeated, and the pulp body is moved by steps to the outlet.

Because of the friction force acting on the pulp body, the pressure in the central portion decreases in the direction toward the pulp outlet. The pressure in the filtrate chamber can therefore be higher than the pressure in the central portion closer to the pulp outlet 9. Due to the valve means 6 provided at the screening casing 2, the filtrate is prevented from returning to the pulp side (see FIG. 7).

During the movement of the pulp body in the central portion a cleaning effect is brought about which prevents clogging of the holes in the screening casing. When the concentration of the pulp body at the inlet end of the screening casing is not sufficiently high, and the movement of the pulp body at this portion is not sufficiently fast to bring about the necessary cleaning effect, said portion of the screening casing may not be provided with a device preventing return flow of the filtrate. The cleaning effect is then ensured by the filtrate chamber 3 being provided with a connection 10 for scavenging liquid, preferably at high pressure, which is preferably activated simultaneously with the closing of the valve in the filtrate outlet 8. In addition to the cleaning of the openings in the screening casing obtained by the aforedescribed return flow, the pulp body is exposed to an additional pushing force, which increases the speed of the pulp body movement in the desired flow direction, i.e., towards the outlet and thereby at the same time also increasing the cleaning effect in the remaining part of the screening casing.

Each of the steps by which the pulp body moves may have a length of several decimeters, which clearly implies that this movement distance is greater, even substantially greater, than the distance between two opposed screen walls. At least in the case of washing, on the other hand, a substantially continuous movement may be preferred, in order to prevent plug formation. In both cases the screening-off of liquid can take place substantially continuously, i.e., the screening-off is resumed during the movement of the pulp body.

The closing and opening, respectively, of the valve in the filtrate outlet 8 can be effected by means of a time relay 53. When return scavenging is applied this function can also be controlled by the relay, preferably so that the valve for the conduit 10 is opened immediately after the outlet 8 has been closed. Instead of controlling the aforesaid functions by suitable time intervals, this control can advantageously be effected by impulses from the inlet pressure in the pulp inlet 7. When the pressure has increased to a predetermined value as measured by detector 55, the valve in the outlet 8 is automatically closed by means of controller 54 and, when required, the valve in the conduit 10 for return scavenging is automatically opened. This system renders the apparatus insensitive to variations in the ingoing pulp concentration, pulp amount, temperature, pulp type, etc.

The outgoing pulp concentration can advantageously be controlled by the pressure in the pulp inlet. Under normal operating conditions, the pressure is adjusted to the value required for the desired outgoing concentration and thereafter maintained constant. The closing of the valve in the filtrate outlet 8 and the opening of the valve for return scavenging can also be controlled by the filtrate flow measured by detector 56. Such control may be especially advantageous when several apparatuses according to the invention are connected in parallel to a common pulp inlet.

Figure 9:
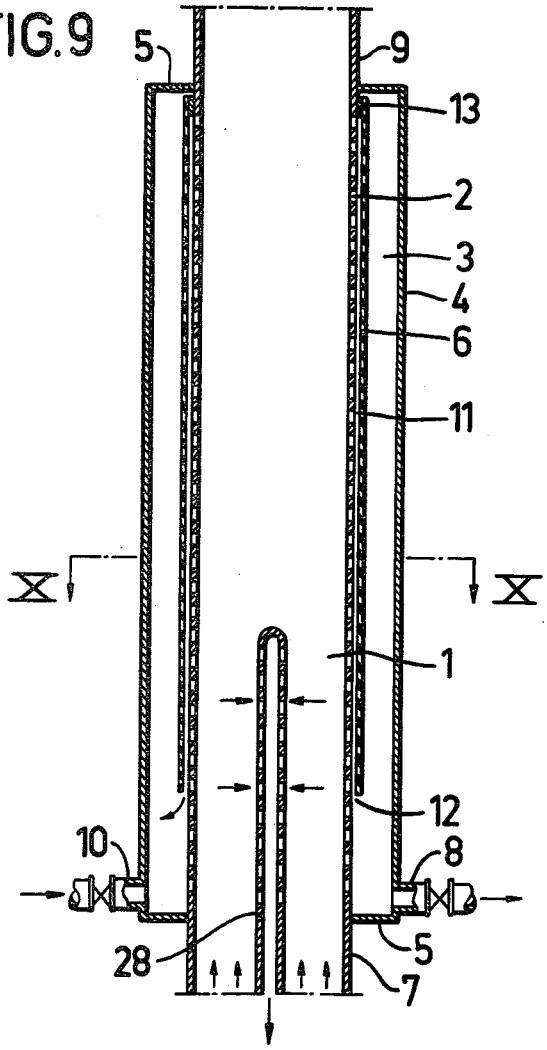
FIG. 9 is an axial sectional view of another embodiment of the apparatus of the present invention.
Figure 10:
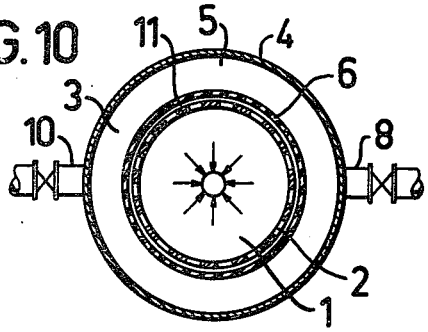
FIG. 10 is a radial sectional view taken along Section X—X of FIG. 9.

In FIGS. 9 and 10 an alternative embodiment is shown in which the screening-off of suspension liquid takes place partly through the screening casing 2 and partly through a member 28 located centrally in the screening casing and preferably designed as a perforated or slotted hollow cylinder or pipe. Screened-off suspension liquid flows off through a filtrate outlet (not shown) provided at the pulp inlet 7 or in another suitable place. When required, return scavenging can take place from inside the pipe. The ratio between the diameter of the screening casing 2 and of the pipe 28 can be smaller than the proportions (about 8:1) shown in FIGS. 9 and 10, for example, between 7:1 and 2:1.

The embodiment according to FIGS. 9 and 10 is particularly favorable for screening-off liquid, i.e., when only an increase in the concentration (thickening) of the cellulose pulp is desired. Washing, however, is also possible in this embodiment by supplying washing liquid centrally from a supply means located beyond the screening-off device 28 in the direction of flow or from supply means located in the gap between the two screening-off screens 2 and 28, which means may be stationary or designed as rotary spray pipes.

As is apparent from the aforesaid, the valve means is to be provided on that side of the screening casing which faces toward the filtrate chamber. The apparatus according to FIGS. 1–10 therefore have a membrane enclosing the screening casing.

Figure 11:
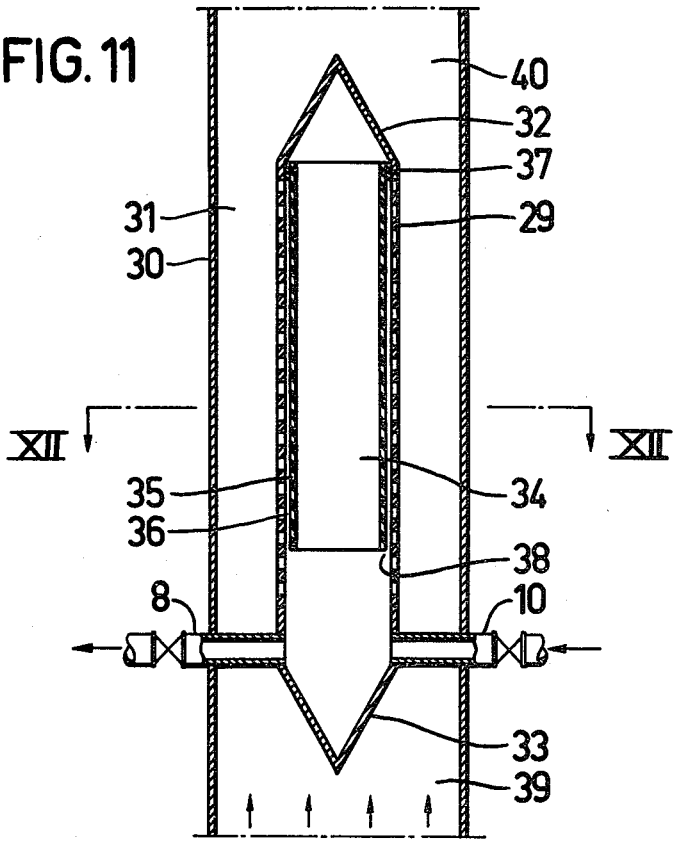
FIG. 11 is an axial sectional view of another apparatus in accordance with the present invention.
Figure 12:
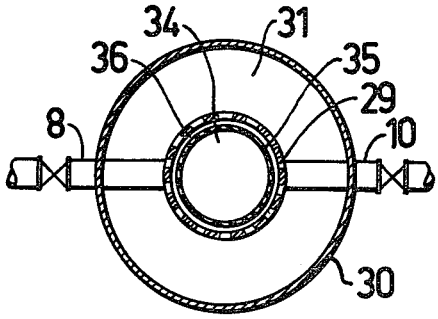
FIG. 12 is a radial sectional view taken along Section XII—XII of FIG. 11.

In the embodiment according to FIGS. 11 and 12 the screening casing is designated by 29, the casing enclosing the treatment passageway by 30, and the treatment space (flow passageway) by 31. The screening casing is provided with two end pieces 32 and 33, which together with the screening casing 29 form a filtrate chamber 34. The screening casing encloses a membrane 35, the outer diameter of which is slightly smaller than the inner diameter of the screening casing, thereby forming a space 36 extending all about. That space 36 is sealed downstream by a ring 37, and is open to the filtrate chamber 34 through a gap 38 in the upstream direction. As in the case of the above embodiments, the filtrate outlet is designated by 8 and the scavenging liquid inlet by 10. The fiber suspension to be treated is supplied in the direction of the arrows through a pulp inlet 39 and is removed through a pulp outlet 40.

In certain embodiments the filtrate outlet 8 should not be located in the lower portion of the filtrate chamber, but more advantageously the outlet, or in any case an extra outlet may be located at the uppermost portion of the filtrate chamber so as to prevent the formation of an air cushion in the upper portion. Such an air cushion, by its compression, can counteract the effect of return scavenging, i.e., the speed of the pressure pulse.

The aforedescribed embodiments can be further modified in several of their details in accordance with the apparatuses disclosed in the following Swedish patent specifications, Pat. Appln. 5813/67 (corresponding to British Pat. No. 1,205,292); Pat. Appln. 12572/68 (corresponding to British Pat. No. 1,287,605) and Pat. Appln 7403408-3 (corresponding to British Pat. No. 1,463,775).

Figure 13:
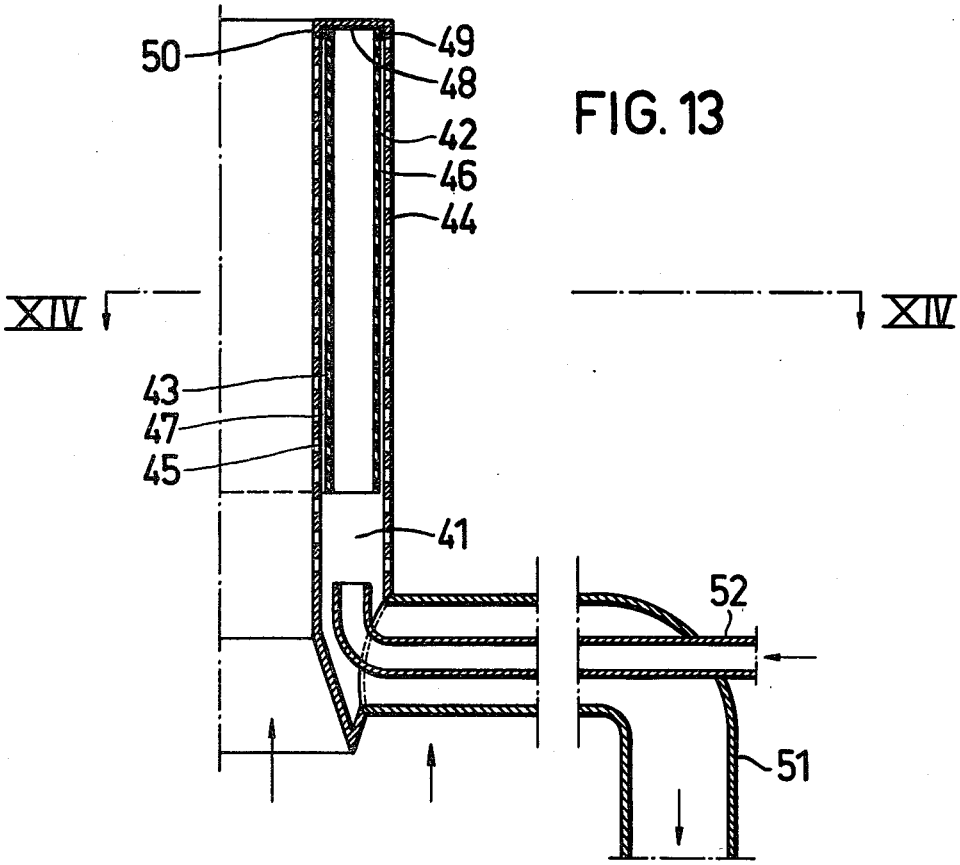
FIG. 13 is a partial axial sectional view of another apparatus in accordance with the present invention.
Figure 14:
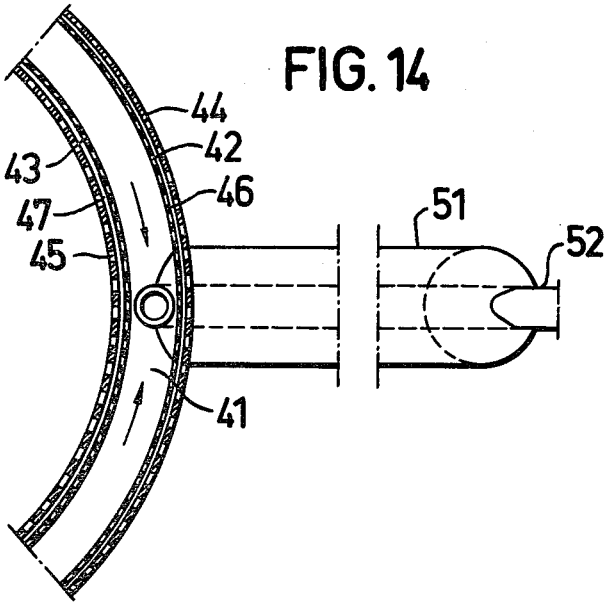
FIG. 14 is a partial radial sectional view taken along Section XIV—XIV of FIG. 13.

FIGS. 13 and 14 illustrate how the invention can be applied to a collecting space (filtrate chamber) in an apparatus according to Swedish Patent Appln. 5183/67. In the collecting space 41 for screened-off liquid two membranes 42 and 43 are provided slightly spaced from the screening casing 44 and screening casing 45, respectively, so that spaces 46 and 47, respectively, extending all about between membranes and screening casings are formed. The membranes connect sealingly to the end portion 48 and rings 49 and 50 of the collecting space 41. Screened-off liquid flows out through a filtrate outlet 51, which may be provided with a water trap (not shown). Scavenging liquid or liquid bringing about pressure impulses is supplied through the conduit 52 from a device producing such impulses. The filtrate outlet 51 may be provided with a valve, which is closed when the pressure impulse is transferred to the collecting space.

The application of the invention to an apparatus according to Swedish Patent Appln. 12572/68 in which pressure impulses (pressure variations) are transferred to the collecting space by intermediate action of a gas, preferably air, can also be described with reference to FIGS. 13 and 14. This design only requires modification with respect to the conduit 52, which is connected to the end portion 48. A volume of air is maintained in the upper portion of the collecting space between the membranes 42 and 43. The height of the air cushion is proposed to be about one-third of the height of the membranes.

In the application of the apparatus according to Swedish Patent Appln. 5183/67 the conduit 52 may also be connected to the upper portion of the collecting space, preferably to the end portion 48, to which portion the filtrate outlet 51 may also be connected.

The aforedescribed modifications according to FIGS. 13 and 14 also apply to the application of the invention at an apparatus according to Swedish Patent Appln. 7403408-3 with the only difference being that the membranes are planar inasmuch as the screening member is planar. The operation of the apparatus according to FIGS. 11–14 shall become readily apparent from the above description with reference to FIGS. 1–10, where it is stated that a space is to be formed between membrane and screening member. It appears from the operation described that during the screening-off process liquid is to be permitted to flow in a counterflow, in relation to the flow direction of the fiber suspension, between membrane and screening member, into the filtrate chamber. When the filtrate outlet is closed and, if required, the scavenging conduit is opened, the membrane is moved so as to entirely or partially abut the screening member and thereby prevent return flow. It is not necessary, however, that the membrane be mounted with a space between the membrane and the screening casing. The function then instead is that the membrane is moved from the screening member during the screening-off process. In this last-mentioned case, the membrane thus abuts the screening member, or is slightly spaced therefrom, in non-operative position.

The extension of the membrane along the screen surface, opposed to the flow direction of the fiber suspension as seen from the mounting downstream, can be chosen so that the size of the membrane is 50–100%, preferably 70–95% and most preferably 80–95% of the screen surface. In connection herewith, however, it is to be pointed out that as the pressure increases in the filtrate chamber, i.e., when the filtrate conduit is closed and/or when return scavenging takes place, the membrane shields off only that portion of the screen surface which is located in the area where the pressure in the flow passageway for the fiber suspension is lower than the pressure in the filtrate chamber.

The membranes utilized as valve means may be manufactured of rubber, plastic, fabrics, thin profiled sheet metal, rigid sheet metal provided with preferably axially extending elastic connections, etc. All membrane designs have in common that the membrane is movable to and away from the screen surface. The membrane, furthermore, has little or no perviousness to liquid.

The invention, of course, is not restricted to the embodiments described, but can be varied within the scope of the invention idea.

I claim:

1. A method for the treatment of liquid-containing substances comprising contacting said liquid-containing substance with separating means as said liquid-containing substance flows in a first direction so that at least a portion of said liquid can be separated from said liquid-containing substance through said separating means as said liquid-containing substance continues to flow in said first direction, said separating means being disposed substantially parallel to said first direction, withdrawing said liquid from said liquid-containing substance through said separating means in a second direction said second direction being substantially perpendicular to said first direction, intermittently interrupting the flow of said liquid downstream from the point of withdrawal of said liquid from said separating means so as to terminate the flow of said liquid through said separating means, and preventing the return flow of at least a portion of said liquid separated from said liquid-containing substance through said separating means during said intermittent interruptions in the flow of said liquid.

2. The method of claim 1 further including supplying additional liquid under pressure to assist in moving said liquid-containing substance in said first direction.

3. The method of claim 2 including detecting the pressure of said liquid-containing substance prior to contacting said liquid-containing substance with said separating means and controlling the supply of said additional liquid in response to a predetermined pressure change associated with said liquid-containing substance.

4. The method of claim 1, wherein said liquid is withdrawn into a collecting chamber including a liquid outlet and further wherein the flow of said liquid is interrupted at said liquid outlet from said collecting chamber.

5. The method of claim 4 further including supplying additional liquid under pressure to assist in moving said liquid-containing substance in said first direction, and wherein said additional liquid is supplied through said collecting chamber.

6. The method of claim 1 including monitoring the flow rate of said liquid through said separating means and interrupting the flow of said liquid in response to predetermined changes in said flow rate.

7. The method of claim 6 including supplying additional liquid under pressure to assist in moving said liquid-containing substance in said first direction, and controlling the supply of said additional liquid in response to said predetermined changes in said flow rate.

8. The method of claim 1 including intermittently interrupting the flow of said liquid at predetermined intervals established by a timer.

9. The method of claim 8 including supplying additional liquid under pressure to assist in moving said liquid-containing substance in said first direction, and intermittently terminating the supply of said additional liquid at predetermined intervals established by a timer.

10. The method of claim 1 including supplying treatment liquid to said liquid-containing substance so as to at least partially exchange said treatment liquid for said liquid separated from said liquid-containing substance.

11. The method of claim 10 wherein said treatment liquid is supplied in a direction substantially transverse to the flow of said liquid-containing substance in said first direction.

12. The method of claim 1 wherein said separating means comprises screen means substantially parallel to said flow of said liquid-containing substance in said first direction.

13. Apparatus for treating a liquid-containing substance comprising means for directing the flow of said liquid-containing substance in a first direction, separating means substantially parallel to the flow of said liquid-containing substance in said first direction for separating at least a portion of said liquid from said liquid-containing substance in a second direction, said second direction being substantially perpendicular to said first direction, means for interrupting the flow of said liquid separated from said liquid-containing substance at a point downstream of said separating means in said second direction, and means for preventing the return flow of at least a portion of said liquid through said separating means during said interruption of said flow of said liquid.

14. The apparatus of claim 13 wherein said means for preventing return flow of at least a portion of said liquid comprises membrane means.

15. The appratus of claim 14 wherein said membrane means is located on the downstream side of said screen means.

16. The apparatus of claim 15 wherein said membrane means covers substantially all of said screen means.

17. The apparatus of claim 15 including a plurality of projecting members located along the exterior wall of said separating means preventing at least a portion of said membrane means from contacting the surface of said separating means when said flow of said liquid separated from said liquid-containing substance is intermittently interrupted.

18. The apparatus of claim 17 wherein said means for directing the flow of said liquid-containing substance is substantially cylindrical, and wherein said projecting members comprise annular-ring means encircling said means for directing the flow of said liquid-containing substance.

19. The apparatus of claim 14 including a collecting chamber for said liquid located downstream of said separating means.

20. The apparatus of claim 19 wherein said collecting chamber includes an outlet and wherein said means for interrupting the flow of said liquid separated from said liquid-containing substance comprises valve means associated with said outlet of said collecting chamber.

21. The apparatus of claim 20 including means for determining the concentration of said liquid-containing substance at a predetermined point, and means for controlling said valve means when said concentration reaches a predetermined valve.

22. The apparatus of claim 19 wherein the means for directing the flow of the liquid-containing substance in said first direction includes inlet means and outlet means.

23. The apparatus of claim 22 wherein said membrane means includes a first end and a second end, and said first end of said membrane means is sealingly attached to said means for directing the flow of the liquid-containing substance at a point adjacent to said outlet means and downstream of said separating means.

24. The apparatus of claim 23 wherein said second end of said membrane means terminates at a point upstream of said outlet means so that said membrane means does not prevent the return flow of a portion of said liquid through a portion of said separating means located upstream of said second end of said membrane means.

25. The apparatus according to claim 19 wherein said collecting chamber includes an inlet for supplying additional liquid to said chamber.

26. The apparatus of claim 25 including valve means associated with said inlet.

27. The apparatus of claim 26 including timer means for controlling said valve means associated with said inlet so that the supply of said additional liquid can be intermittently timed.

28. The apparatus of claim 14 including a plurality of said membrane means.

29. The apparatus of claim 28 including a collecting chamber for said liquid downstream of said separating means, and wherein said collecting chamber includes a plurality of collecting chamber compartments extending axially along said means for directing the flow of said liquid-containing substance.

30. The apparatus of claim 29 wherein each of said collecting chamber compartments includes one of said plurality of membranes.

31. The apparatus of claim 30 wherein each of said plurality of membranes is sealingly attached to said separating means along the axially-extending edges thereof.

32. The apparatus of claim 28 wherein each of said plurality of membranes extends longitudinally along a portion of the length of said separating means.

33. The apparatus of claim 32 wherein each of said membranes includes a first end and a second end, said first end being located downstream of said separating means and being sealingly attached thereto.

34. The apparatus of claim 28 including a plurality of liquid-collecting chambers located on the external surface of said separating means so that said liquid passing through said separating means is collected therein, each of said liquid-collecting chambers including outlet means, and further wherein each of said plurality of membranes is associated with said outlet means of said liquid-collecting chambers.

35. The apparatus of claim 34 wherein said liquid-collecting chambers are defined by a plurality of wall members disposed on the external surface of said separating means.

36. The apparatus of claim 35 wherein each of said plurality of membranes includes a first end and a second end, said first end being located downstream of said second end with respect to said means for directing the flow of said liquid-containing substance, and said first end being sealingly affixed to said separating means.

37. The apparatus of claim 28 including a plurality of liquid collecting chambers located on the external surface of said separating means so that said liquid passing through said separating means is collected therein, each of said liquid-collecting chambers being defined by axially extending wall means disposed on the external surface of said separating means.

38. The apparatus of claim 13 wherein said separating means is located within said means for directing the flow of said liquid-containing substance, and said means for preventing the return flow of at least a portion of said liquid through said separating means is located on the interior surface of said separating means.

39. The apparatus of claim 38 wherein said means for preventing the return flow of at least a portion of said liquid comprises membrane means.

40. The apparatus of claim 38 including outlet means for said liquid passing through said separating means.

41. The apparatus of claim 40, wherein said means for interrupting the flow of said liquid-containing substance comprises valve means associated with said outlet means.

42. The apparatus of claim 41 including means for supplying additional liquid to said separating means.

43. The apparatus of claim 42 including valve means associated with said means for supplying additional liquid to said separating means.

44. The apparatus of claim 13 including supply means for the addition of treatment liquid to said liquid-containing substance within said means for directing the flow of said liquid-containing substance.

45. Apparatus for treating a liquid-containing substance comprising means for directing the flow of said liquid-containing substance in a first direction, said means for directing the flow of said liquid-containing substance including inlet means and outlet means, separating means for separating at least a portion of said liquid from said liquid-containing substance in a second direction, a collecting chamber for said liquid located downstream of said separating means, said collecting chamber including an outlet, means for interrupting the flow of said liquid separted from said liquid-containing substance at a point downstream of said separating means in said second direction, comprising valve means associated with said outlet of said collecting chamber, and membrane means for preventing the return flow of at least a portion of said liquid through said separating means, said membrane means including a first end and a second end, said first end of said membrane means being sealingly attached to said means for directing the flow of said liquid-containing substance at a point adjacent to said outlet means and downstream of said separating means.

46. The apparatus of claim 45 wherein said second end of said membrane means terminates at a point downstream of said inlet means so that said membrane means does not prevent the return flow of a portion of said liquid through a portion of said separating means located upstream of said second end of said membrane means.

47. Apparatus for treating a liquid-containing substance comprising means for directing the flow of said liquid-containing substance in a first direction, separating means for separating at least a portion of said liquid from said liquid-containing substance in a second direction, means for interrupting the flow of said liquid separated from said liquid-containing substance at a point downstream of said separating means at said second direction, and a plurality of membrane means for preventing the return flow of at least a portion of said liquid through said separating means.

48. The apparatus of claim 47 including a collecting chamber for said liquid downstream of said separating means, and wherein said collecting chamber includes a plurality of collecting chamber compartments extending axially along said means for directing the flow of said liquid-containing substance.

49. The apparatus of claim 48 wherein each of said collecting chamber compartments includes one of said plurality of membranes.

50. The apparatus of claim 49 wherein each of said plurality of membranes is sealingly attached to said separating means along the axially extending edges thereof.

51. The apparatus of claim 47 wherein each of said plurality of membranes extends longitudinally along a portion of the length of said separating means.

52. The apparatus of claim 51 wherein each of said membranes includes a first end and a second end, said first end being located in the downstream direction of said separating means and being sealingly attached thereto.

53. The apparatus of claim 47 including a plurality of liquid collecting chambers located on the external surface of said separating means so that said liquid passing through said separating means is collected therein, each of said liquid collecting chambers including outlet means, and further wherein each of said plurality of membranes is associated with said outlet means of said liquid collecting chambers.

54. The apparatus of claim 53 wherein said liquid collecting chambers are defined by a plurality of wall members disposed on the external surface of said separating means.

55. The apparatus of claim 54 wherein each of said plurality of membranes includes a first end and a second end, said first end being located downstream of said second end with respect to said means for directing the flow of said liquid-containing substance, and said first end being sealingly affixed to said separating means.

56. The apparatus of claim 47 including a plurality of liquid collecting chambers located on the external surface of said separating means so that said liquid passing through said separating means is collected therein, each of said liquid collecting chambers being defined by axially extending wall means disposed on the external surface of said separating means.

57. Apparatus for treating a liquid-containing substance comprising means for directing the flow of said liquid-containing substance in a first direction, separating means for separating at least a portion of said liquid from said liquid-containing substance in a second direction, means for interrupting the flow of said liquid separated from said liquid-containing substance at a point downstream of said separating means in said second direction, membrane means located on the downstream side of said separating means for preventing the return flow of at least a portion of said liquid through said separating means, and a plurality of projecting members located along the exterior wall of said separating means preventing at least a portion of said membrane means from contacting the surface of said separating means when said flow of said liquid is separated from said liquid-containing substance is intermittently interrupted, said means for directing the flow of said liquid-containing substance being substantially cylindrical, and said projecting members comprising annular ring means encircling said means for directing the flow of said liquid-containing substance.

* * * * *